US005499518A

United States Patent [19]

Shieh

[11] Patent Number: 5,499,518

[45] Date of Patent: Mar. 19, 1996

[54] MULTISTEPPED DISK BRAKE LOCK FOR MOTORCYCLE

[76] Inventor: Jin-Ren Shieh, No. 178, Shih Chia Rd., Taichung, Taiwan

[21] Appl. No.: 501,663

[22] Filed: Jul. 12, 1995

[51] Int. Cl.[6] ..... E05B 67/36

[52] U.S. Cl. ..... 70/233; 70/226; 70/360; 188/69

[58] Field of Search ..... 188/69, 265, 353; 70/33, 42, 225, 226, 233, 360

[56] References Cited

U.S. PATENT DOCUMENTS

| | | | |
|---|---|---|---|
| 577,248 | 2/1897 | Gessler | 70/360 |
| 5,379,618 | 1/1995 | Shieh | 70/33 |
| 5,442,941 | 8/1995 | Kahonen et al. | 70/33 X |

*Primary Examiner*—Robert J. Oberleitner
*Assistant Examiner*—Lee W. Young
*Attorney, Agent, or Firm*—Browdy and Neimark

[57] ABSTRACT

A motorcycle disk brake lock comprises a main body, a locking member, a firs stopping member, a second stopping member, and a third stopping member. The main body is composed of a slot, a receiving space, and a through hole located between the slot and the receiving space in which the locking member is disposed. The locking member is provided with a press portion and a locating rod capable of moving along with the press portion. The first stopping member is located on the locking member. The second stopping portion is located on the inner edge of the receiving space such that the second stopping portion is capable making contact with the first stopping portion so as to prevent the locking member from being driven to move outwards. The third stopping portion is located on the inner edge of the receiving space such that the third stopping portion is parallel to the second stopping portion and is also able to prevent the locking member from being driven to move outwards.

8 Claims, 2 Drawing Sheets

MULTISTEPPED DISK BRAKE LOCK FOR MOTORCYCLE

FIELD OF THE INVENTION

The present invention relates generally to a motorcycle disk brake lock, and more particularly to a multistepped disk brake lock for motorcycle.

BACKGROUND OF THE INVENTION

The conventional motorcycle disk brake lock is generally composed of a main body and a locking member. The main body is provided with a slot for receiving therein a motorcycle disk brake. The locking member comprises an inner side capable of moving in a reciprocating manner and across the slot, and an outer side capable of being controlled by a key. In operation, the edge of the disk brake is placed in the slot before the inner side of the locking member is pushed across the two opposite inner walls of the slot such that the inner side of the locking member is put through a heat-radiating hole of the disk brake. The disk brake lock can be disengaged with the disk brake by using a designated key to rotate the outer side of the locking member so as to cause the inner side of the locking member to be forced out of the slot by a spring.

Such a prior art motorcycle disk brake lock as described above is defective in design in that a specific tool can be inserted into the key hole of the outer side of the locking member to push away the retaining pins of the locking member so as to release the inner side of the locking member. In other words, the prior art motorcycle disk brake lock can be tampered with easily by an unauthorized person.

SUMMARY OF THE INVENTION

It is therefore the primary objective of the present invention to provide a motorcycle disk brake lock comprising a locking member which can not be easily tampered with.

The foregoing objective of the present invention is attained by the motorcycle disk brake lock, which comprises a main body, a locking member, a first stopping member, a second stopping member, and a third stopping member. The main body is composed of a slot, a receiving space, and a through hole located between the slot and the receiving space in which the locking member is disposed. The locking member is provided with a press portion and a locating rod capable of moving along with the press portion. The first stopping portion is located on the locking member. The second stopping portion is located on the inner edge of the receiving space such that the second stopping portion is capable of making contact with the first stopping portion so as to prevent the locking member from being moved outwards. The third stopping portion is located on the inner edge of the receiving space such that the third stopping portion is parallel to the second stopping portion and is also able to prevent the locking member from being moved outwards.

The foregoing objective, features, functions and advantages of the present invention can be more easily understood upon a thoughtful deliberation of the following detailed description of the embodiments of the present invention in conjunction with the accompanying drawings.

DETAILED DESCRIPTION OF THE INVENTION

Figure 1:
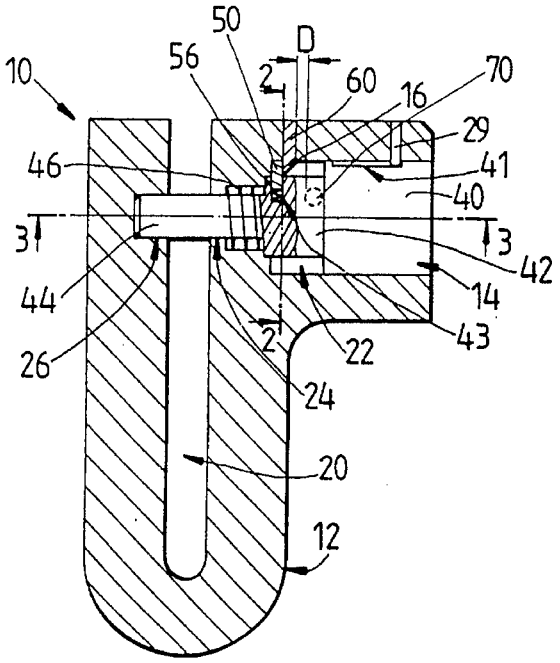
FIG. 1 shows a sectional view of a first preferred embodiment of the present invention.
Figure 2:
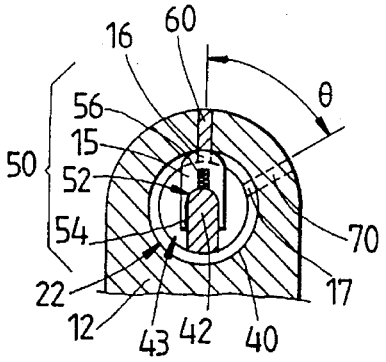
FIG. 2 shows a sectional view of a portion taken along the line 2—2 as shown in FIG. 1.
Figure 3:
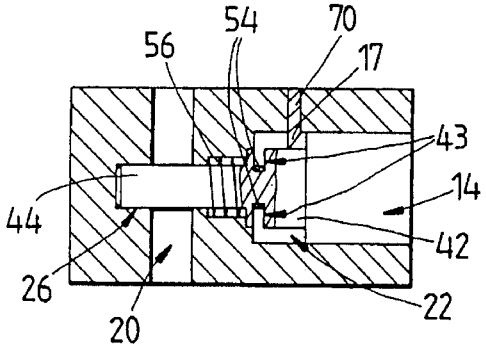
FIG. 3 shows a sectional view of a portion taken along the line 3—3 as shown in FIG. 1.

As shown in FIGS. 1–3, a motorcycle disk brake lock 10 of the present invention comprises a main body 12, a locking member 14, a first stopping portion 15, a second stopping portion 16, and a third stopping portion 17.

The main body 12 is composed of a slot 20 dimensioned to receive therein a motorcycle disk brake (not shown in the drawings), a receiving space 22, a through hole 24 located between the slot 20 and the receiving space 22, a recess 26 located on the inner wall of the slot 20 such that the recess 26 is coaxial with the through hole 24, and a locating pin 29 having one end extending into the receiving space 22.

The locking member 14 is composed of a press portion 40 received slidably in the receiving space 22, a locating rod 44, and a retrieving spring 46. The press portion 40 is provided with a long slot 41 into which one end of the locating pin 29 is extended, and with a driving portion 42 capable of moving along with the press portion 40 and having peripherally two retaining slots 43 spaced at 180 degrees. The locating rod 44 is capable of moving back and forth in the through hole 24 and across the slot 20 such that one end of the locating rod 44 is received in the recess 26. The spring 46 is fitted over the locating rod 44 such that both ends of the spring 46 urge respectively the bottom of the receiving space 22 and the driving portion 42.

The first stopping portion 15 has a stopping member 50 provided centrally with an indentation 52 dimensioned to fit over the driving portion 42. The stopping member 50 is further provided at one end thereof with two locating feet 54 dimensioned to fit into the two retaining slots 43 and is further provided at another end thereof with the first stopping portion 15. A coil spring 56 is disposed between the inner edge of the indentation 52 and the driving portion 42 so as to provide a force exerting on the first stopping portion 15.

The second stopping portion 16 is located on a retaining pin 60 and is provided with an inclined side.

The third stopping portion 17 is located on a retaining pin 70 such that the third stopping portion 17 is parallel to the axis of the receiving space 22, and that the third stopping portion 17 is separated from the second stopping portion 16 by a distance D. The axis of the receiving space 22 forms an angle θ of 60 degrees with an imagination line connecting the second and the third stopping portions 16 and 17.

In operation, a key (not shown in the drawing) is first inserted into the press portion 40 to force the driving portion 42 and the first stopping portion 15 to turn clockwise for an angle of 60 degrees, as shown in FIG. 2, so as to separate the first stopping portion 15 from the second stopping portion 16. In the meantime, the driving portion 42 is forced by the spring 46 to move outwards such that the first stopping portion 15 is obstructed by the third stopping portion 17. The press portion 40 is turned again to force the first stopping portion 15 to turn counterclockwise for an angle of 60 degrees so that the first stopping portion 15 is no longer obstructed by the third stopping portion 17, and that the locating rod 44 is caused to disengage the slot 20.

In the process of locking the motorcycle disk brake lock 10, the first stopping portion 15 is turned such that it is corresponding in location to the second stopping portion 16. Thereafter, the press portion 40 is pushed leftwards with finger so as to cause the first stopping portion 15 to slide along the inclined surface of the second stopping portion 16, thereby causing the first stopping portion 15 to be obstructed.

An unauthorized person will encounter with a considerable difficulty in forcing the driving portion 42 to turn in view of the fact that the tool used by the unauthorized person to tamper with the lock 10 will be forced out by the spring 46 as soon as the driving portion 42 is turned by the tool.

Figure 4:
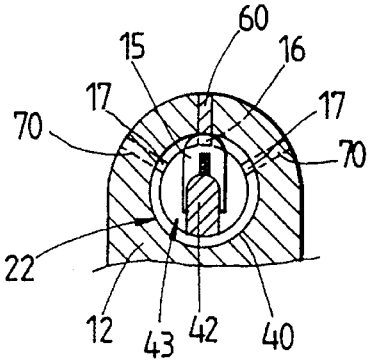
FIG. 4 shows a sectional view of a second preferred embodiment of the present invention.
Figure 5:
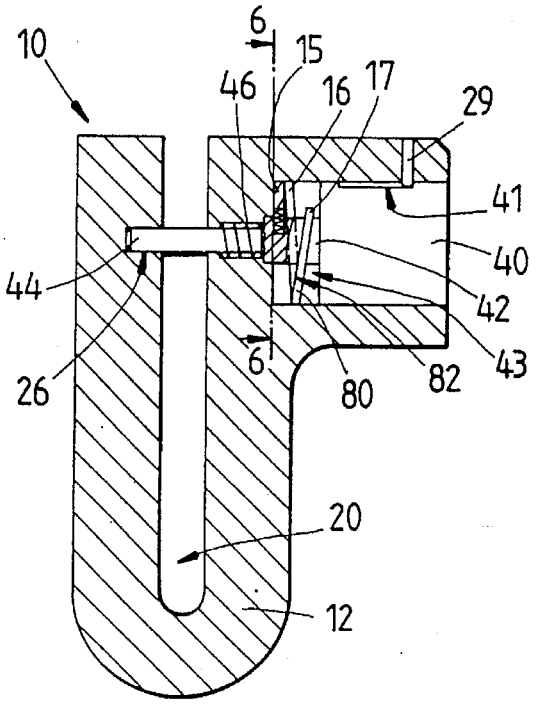
FIG. 5 shows a sectional view of a third preferred embodiment of the present invention.

As shown in FIG. 4, the locking member 14 is provided with the driving portion 42 which can be turned only within the range of 90 degrees or slightly larger than 90 degrees. In the meantime, the receiving space 22 is provided therein with two third stopping portions 17 spaced at an angle of 120 degrees, or with three third stopping portions 17 depending on the width of the first stopping portion 15.

As shown in FIGS. 5–8, the second and the third stopping portions 16 and 17 are so set up that they form respectively with the receiving space 22 an angle smaller than 60 degrees, and that they are provided integrally therebetween with a connection portion 80 having a stopping surface 82.

Figure 6:
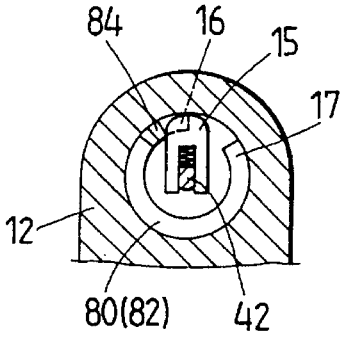
FIG. 6 shows a sectional view of a portion taken along the line 6—6 as shown in FIG. 5, illustrating that the first and the second stopping portions are in contact with each other.
Figure 7:
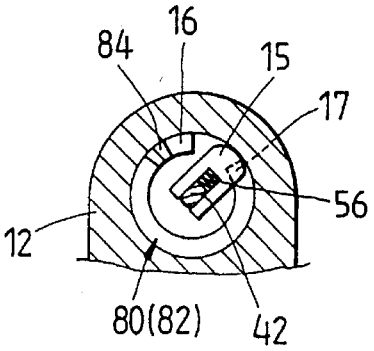
FIG. 7 is a sectional view of a portion taken along the line 6—6 as shown in FIG. 5, showing that the first and the third stopping portions are in contact with each other.
Figure 8:
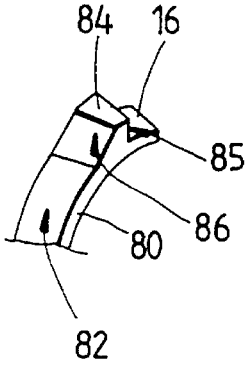
FIG. 8 shows a schematic view of a connection member and an arresting block of the third preferred embodiment of the present invention.

When an unauthorized person tries to tamper with the lock 10 by forcing the driving portion 42 to turn clockwise with a specific tool, the first stopping portion 15 is forced by the spring 46 to make contact with the third stopping portion 17, as shown in FIG. 7. If the unauthorized person tries to tamper with the lock 10 by forcing the driving portion 42 to turn clockwise, such a tampering action will result in forcing the first stopping portion 15 to slide along the stopping surface 82 of the connection portion 80 to be in contact with the second stopping portion 16, as shown in FIG. 6. As a result, the lock 10 remains in a locking state in spite of the desperate attempt made by the unauthorized person to tamper with the lock 10.

Moreover, the stopping surface 82 is provided with an arresting block 84 contiguous to the second stopping portion 16 and having an arresting surface 85 on one side thereof. The arresting surface 85 faces the second stopping portion 16 such that the arresting surface 85 is parallel to the axis of the receiving space 22. The arresting surface 85 has another side which is opposite to the one side referred to above and is provided thereon with an inclined surface 86. The arresting surface 85 serves to prevent the first stopping portion 15 from being turned counterclockwise when the first stopping portion 15 is in contact with the second stopping portion 16. However, the arresting surface 85 does not prevent the first stopping portion 15 from sliding along the stopping surface 82 and the inclined surface 86 to arrive at the left side of the second stopping portion 16.

The embodiments of the present invention described above are to be regarded in all respects as merely illustrative and not restrictive. Accordingly, the present invention may be embodied in other specific forms without deviating from the spirit thereof. For example, the receiving space 22 of the lock 10 of the present invention may be provided with a plurality of second stopping portions 16, third stopping portions 17 and connection portions 80 for making the lock 10 more burglaryproof. The present invention is therefore to be limited only by the scope of the following appended claims.

What is claimed is:

1. A motorcycle disk brake lock comprising:

a main body provided with a slot, a receiving space, and a through hole located between said slot and said receiving space;

a locking member disposed in said receiving space and provided with a press portion movable back and forth in said through hole, said locking member further provided with a locating rod movable along with said press portion;

a first stopping portion located on said locking member such that said first stopping portion can be driven by said locking member to move back and forth along a predetermined direction; and a second stopping portion located on an inner edge of said receiving space such that said second stopping portion can be caused to make contact with said first stopping portion so as to prevent said locking member from being driven forcibly to move toward the outside of said receiving space;

wherein said receiving space is provided on said inner edge thereof with a third stopping portion which is separated from said second stopping portion by a predetermined distance parallel to a direction in which said first stopping portion is caused to move back and forth, said third stopping portion capable of cooperating with said first stopping portion to prevent said locking member from being driven forcibly to move toward the outside of said receiving space.

2. The motorcycle disk brake lock as defined in claim 1, wherein said locking member is provided with an arresting member capable of being driven by said locking member to turn in a predetermined direction, said arresting member provided with a resilient member located between said arresting member and said locking member, said arresting member further provided at one end thereof with said first stopping portion.

3. The motorcycle disk brake lock as defined in claim 2, wherein said arresting member has a predetermined thickness and is of a platelike construction, said arresting member provided with an indentation and two locating feet; and wherein said locking member is provided with a driving portion on which said two locating feet are located.

4. The motorcycle disk brake lock as defined in claim 1, wherein said receiving space has an axis which forms a predetermined angle with a line connecting said second stopping portion with said third stopping portion.

5. The motorcycle disk brake lock as defined in claim 1, wherein said receiving space is provided therein with a connection portion located between said second stopping portion and said third stopping portion.

6. The motorcycle disk brake lock as defined in claim 5, wherein said connection portion is provided thereon with a stopping surface on which said first stopping portion can slide.

7. The motorcycle disk brake lock as defined in claim 5, wherein said second stopping portion is provided with an arresting block contiguous to said connection portion for confining a moving direction of said first stopping portion.

8. The motorcycle disk brake lock as defined in claim 7, wherein said arresting block has an arresting surface perpendicular to said inner edge of said receiving space, said arresting block further having an inclined surface opposite in location to said arresting surface.

* * * * *